US007611206B2

(12) United States Patent
Tsai

(10) Patent No.: US 7,611,206 B2
(45) Date of Patent: Nov. 3, 2009

(54) INTERNALLY PULLING TYPE LIFT DEVICE FOR CHAIR ARMREST

(76) Inventor: Po-Chuan Tsai, 226-16, Zhung Zhou, Zhungsheng Cun, Rende Hsiang, Tainan Hsien (TW)

( * ) Notice: Subject to any disclaimer, the term of this patent is extended or adjusted under 35 U.S.C. 154(b) by 197 days.

(21) Appl. No.: 11/869,934

(22) Filed: Oct. 10, 2007

(65) Prior Publication Data

US 2009/0096271 A1 Apr. 16, 2009

(51) Int. Cl.
*B60N 2/46* (2006.01)

(52) U.S. Cl. ..... 297/411.36

(58) Field of Classification Search ..... 297/411.36, 297/353

See application file for complete search history.

(56) References Cited

U.S. PATENT DOCUMENTS 6,398,309 B1 * 6/2002 Chen ..... 297/411.36
6,976,739 B2 * 12/2005 Wang ..... 297/411.36
7,156,466 B1 * 1/2007 Chang ..... 297/411.36
7,246,859 B2 * 7/2007 Igarashi et al. ..... 297/411.36
7,419,219 B2 * 9/2008 Grove ..... 297/411.36
7,448,687 B2 * 11/2008 Tsai ..... 297/411.36
2007/0164595 A1 * 7/2007 Chi ..... 297/411.36

* cited by examiner

*Primary Examiner*—Anthony D Barfield
(74) *Attorney, Agent, or Firm*—Alan Kamrath; Kamrath & Associates PA

(57) ABSTRACT

An internally pulling type lift device for a chair armrest includes an outer pipe, a guide track, an inner pipe, a follower, a locking member, a pull handle, a control knob, a restoring spring, and a torsion spring. Thus, the guide track, the follower and the inner pipe are encompassed by the outer pipe so that the manufacturer only needs to spray paint on the outer pipe without having to spray paint on the guide track, the follower and the inner pipe, thereby saving the working time and decreasing the costs of fabrication. In addition, the inner pipe is movable in the outer pipe so that the inner pipe will not rub or scratch the outer surface of the outer pipe, thereby enhancing the aesthetic quality of the outer pipe.

18 Claims, 5 Drawing Sheets

INTERNALLY PULLING TYPE LIFT DEVICE FOR CHAIR ARMREST

BACKGROUND OF THE INVENTION

1. Field of the Invention

The present invention relates to a lift device and, more particularly, to an internally pulling type lift device for a chair armrest.

2. Description of the Related Art

A conventional externally pulling type lift device 1 for a chair armrest in accordance with the prior art shown in FIG. 5 comprises a support post 10, an adjusting pipe 11 movably mounted on the support post 10 and detachably locked on the support post 10 by a locking member 13, and an armrest support 12 mounted on the upper end of the support post 10. Thus, when the adjusting pipe 11 is unlocked from the locking member 13, the adjusting pipe 11 is movable relative to the support post 10 to adjust the height of the armrest support 12 relative to the support post 10 so as to adjust the height of the chair armrest.

However, the adjusting pipe 11 is movable on the support post 10 frequently, so that the adjusting pipe 11 easily rubs and wear the outer surface of the support post 10, thereby decreasing the aesthetic quality of the support post 10. In addition, the manufacturer needs to spray paint on the adjusting pipe 11 and the support post 10, thereby increasing the working time and increasing the costs of fabrication.

BRIEF SUMMARY OF THE INVENTION

In accordance with the present invention, there is provided a lift device, comprising an outer pipe, a guide track secured in the outer pipe and having two opposite sides each formed with a plurality of locking grooves, an inner pipe movably mounted in the guide track, a follower having an upper end secured to a lower end of the inner pipe to move with the inner pipe, a locking member pivotally mounted in a lower end of the follower and having two opposites ends each formed with a locking portion protruding from the follower and detachably locked in one of the locking grooves of the guide track to detachably lock the follower and the inner pipe in the guide track, a pull handle movably mounted in the inner pipe and having a lower end which is movable to press and pivot the locking member toward the guide track so as to lock the locking portion of the locking member in one of the locking grooves of the guide track, a control knob movably mounted on an upper end of the inner pipe and connected to an upper end of the pull handle to move the pull handle to press or detach from the locking member, and a restoring spring mounted on the pull handle and biased between the follower and the lower end of the pull handle to push the lower end of the pull handle toward the locking member.

The primary objective of the present invention is to provide an internally pulling type lift device for a chair armrest.

Another objective of the present invention is to provide a lift device, wherein the guide track, the follower and the inner pipe are encompassed by the outer pipe so that the manufacturer only needs to spray paint on the outer pipe without having to spray paint on the guide track, the follower and the inner pipe, thereby saving the working time and decreasing the costs of fabrication.

A further objective of the present invention is to provide a lift device, wherein the inner pipe is movable in the outer pipe so that the inner pipe will not rub or scratch the outer surface of the outer pipe during a long-term utilization, thereby enhancing the aesthetic quality of the outer pipe.

A further objective of the present invention is to provide a lift device, wherein the inner pipe is locked onto or unlocked from the outer pipe by pulling or releasing the control knob, so that the lift device is operated easily and rapidly, thereby facilitating a user operating the lift device to adjust the height of the armrest.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
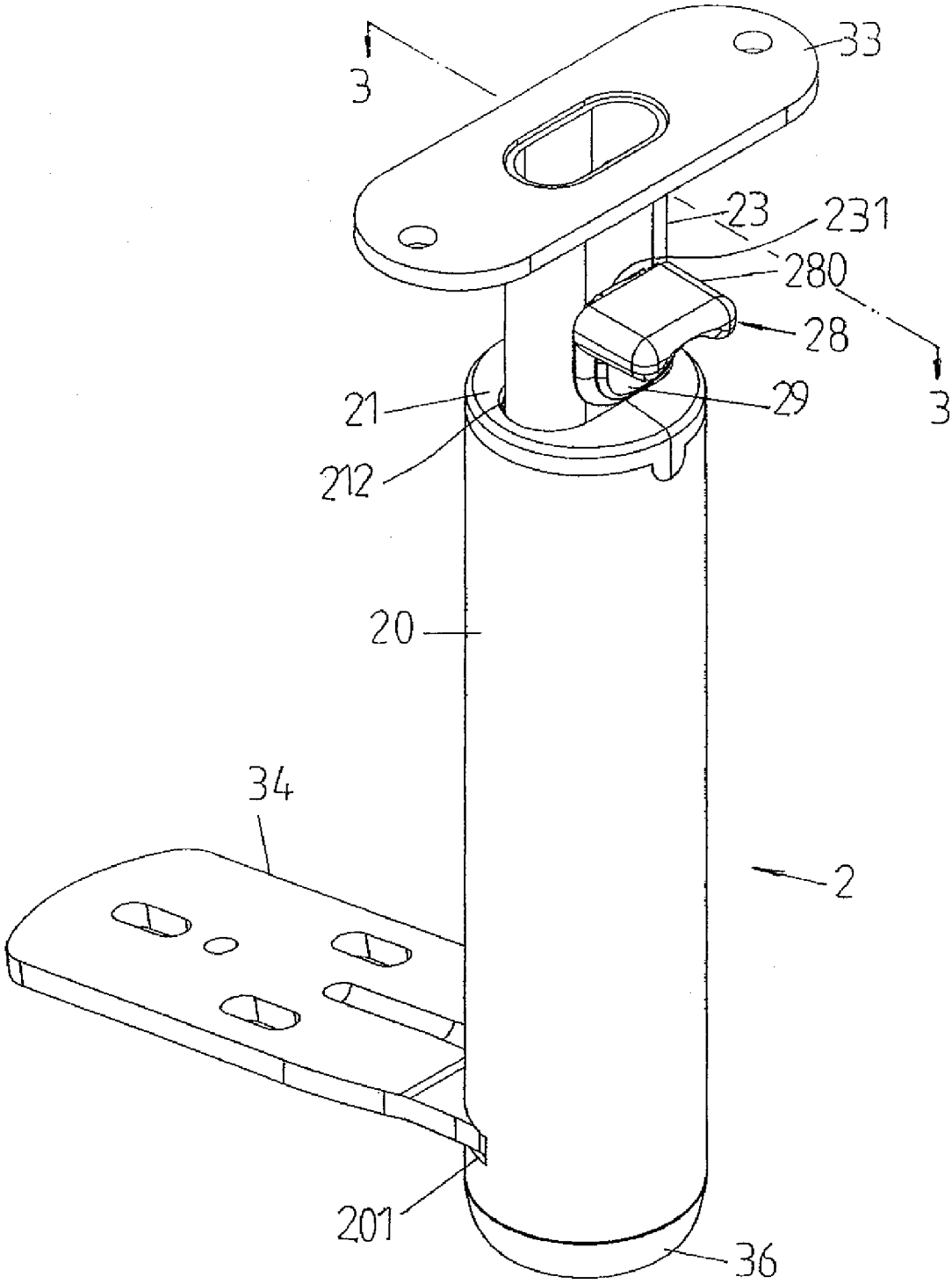
FIG. 1 is a perspective view of a lift device for a chair armrest in accordance with the preferred embodiment of the present invention.
Figure 2:
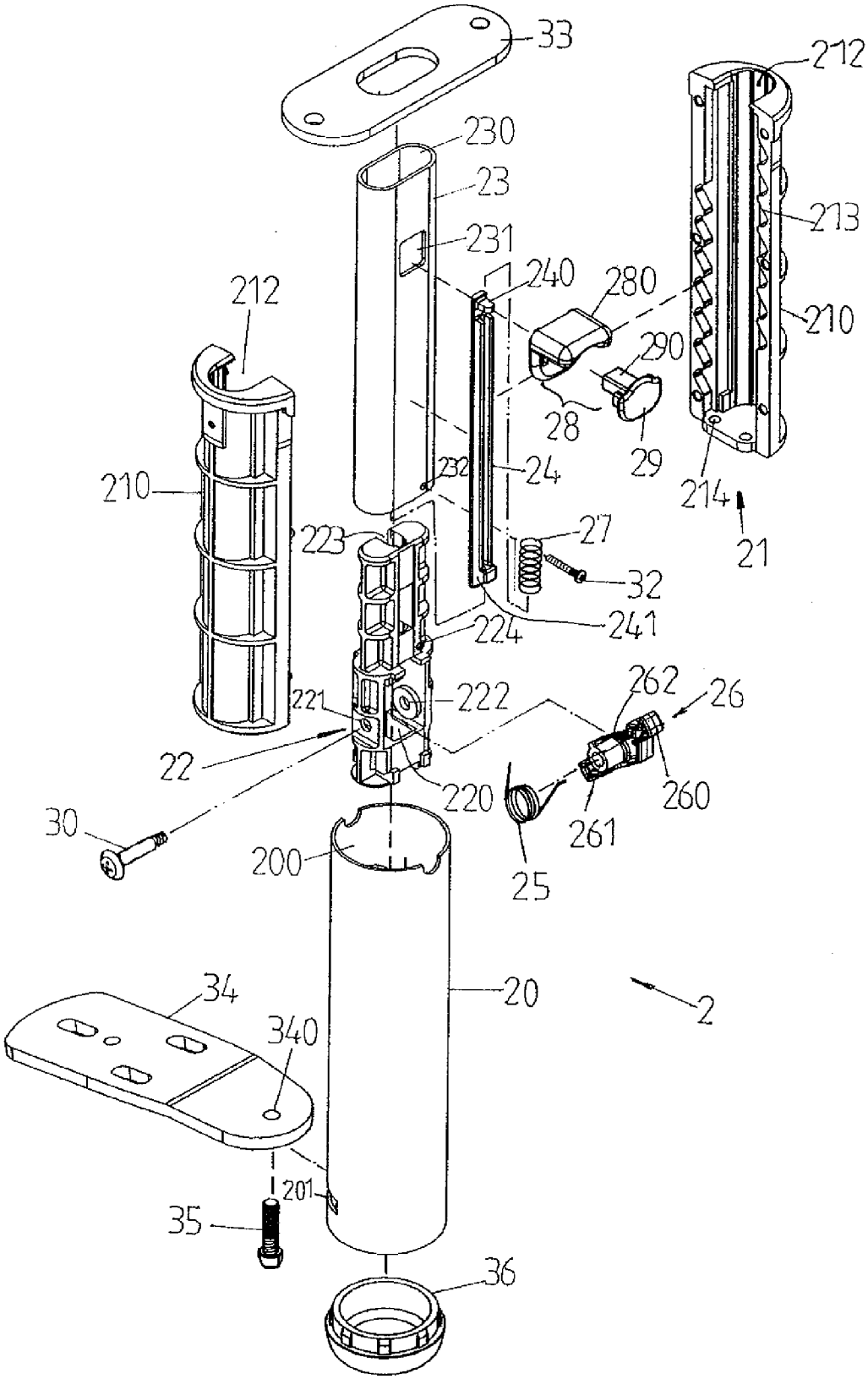
FIG. 2 is an exploded perspective view of the lift device as shown in FIG. 1.
Figure 3:
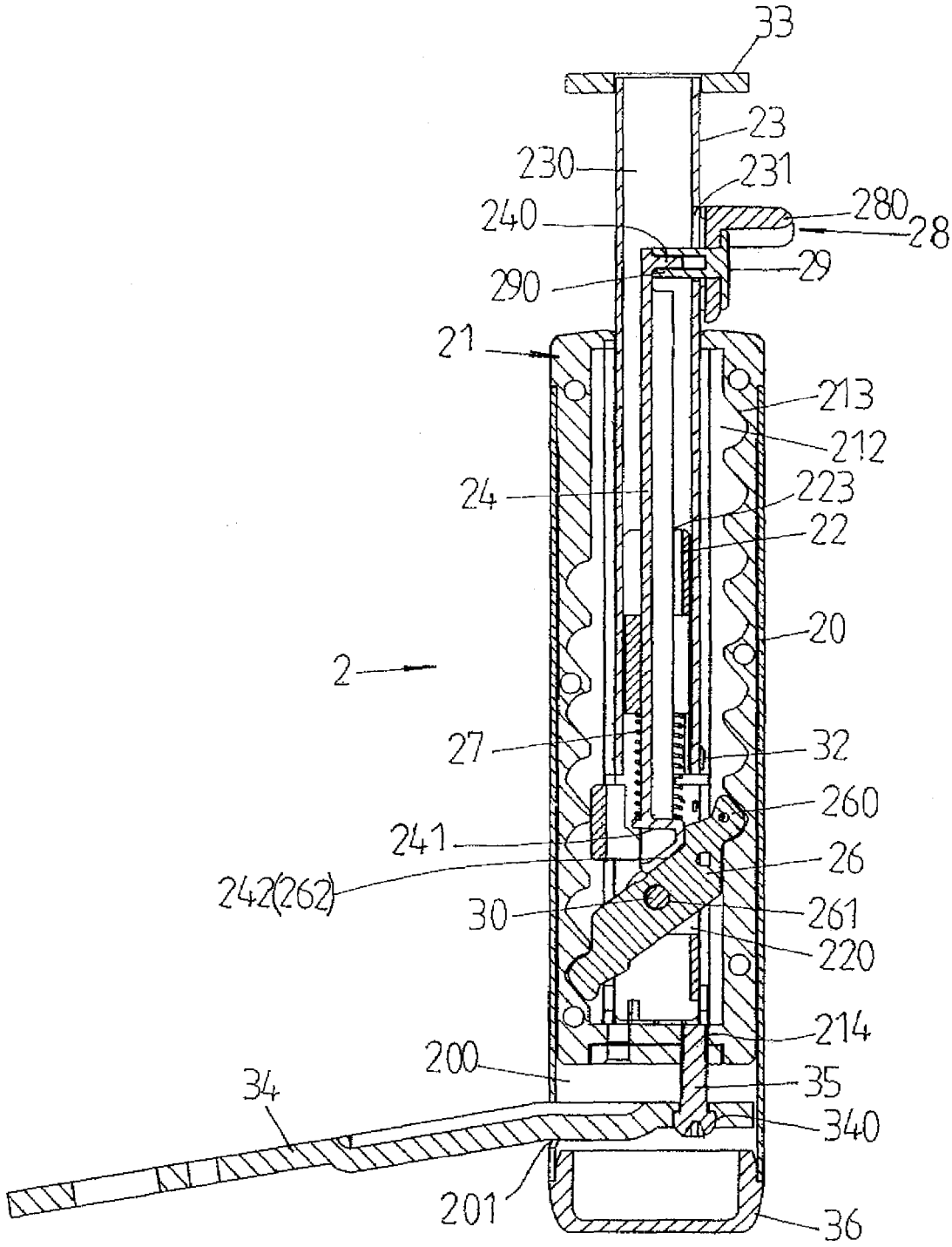
FIG. 3 is a front cross-sectional view of the lift device taken along line 3-3 as shown in FIG. 1.

Referring to the drawings and initially to FIGS. 1-3, a lift device 2 for a chair armrest in accordance with the preferred embodiment of the present invention comprises an outer pipe 20, a guide track 21 secured in the outer pipe 20 and having two opposite sides each formed with a plurality of locking grooves 213, an inner pipe 23 movably mounted in the guide track 21, a follower 22 having an upper end secured to a lower end of the inner pipe 23 to move with the inner pipe 23, a locking member 26 pivotally mounted in a lower end of the follower 22 and having two opposites ends each formed with a locking portion 260 protruding from the follower 22 and detachably locked in one of the locking grooves 213 of the guide track 21 to detachably lock the follower 22 and the inner pipe 23 in the guide track 21, a pull handle 24 movably mounted in the inner pipe 23 and having a lower end 241 which is movable to press and pivot the locking member 26 toward the guide track 21 so as to lock the locking portion 260 of the locking member 26 in one of the locking grooves 213 of the guide track 21, a control knob 28 movably mounted on an upper end of the inner pipe 23 and connected to an upper end of the pull handle 24 to move the pull handle 24 to press or detach from the locking member 26, a restoring spring 27 mounted on the pull handle 24 and biased between the follower 22 and the lower end 241 of the pull handle 24 to push the lower end 241 of the pull handle 24 toward the locking member 26, and a torsion spring 25 mounted on the locking member 26 and biased between the follower 22 and the locking member 26 to push and pivot the locking member 26 away from the guide track 21 so as to unlock the locking portion 260 of the locking member 26 from the respective locking groove 213 of the guide track 21 after the lower end 241 of the pull handle 24 is movable to detach from the locking member 26.

The outer pipe 20 has an inside formed with a mounting chamber 200 for mounting the guide track 21. The outer pipe 20 has a lower end having a peripheral wall formed with a passage 201 connected to the mounting chamber 200. The outer pipe 20 is attached to a fixing plate 34 which has a distal end extending through the passage 201 into the mounting chamber 200 of the outer pipe 20. The distal end of the fixing plate 34 is secured to the guide track 21 and formed with a through hole 340.

The guide track 21 consists of two substantially semi-cylindrical shells 210 combined with each other. The guide track 21 has inside formed with a slideway 212 connected to the locking grooves 213 to allow sliding movement of the inner pipe 23 and the follower 22. The guide track 21 has a lower end formed with at least one screw bore 214.

The lift device further comprises at least one locking screw 35 extending through the through hole 340 of the fixing plate 34 and screwed into the screw bore 214 of the guide track 21, so that the guide track 21 is fixed on the fixing plate 34 to attach the outer pipe 20 onto the fixing plate 34, and a bottom cap 36 mounted on the lower end of the outer pipe 20 to close the lower end of the outer pipe 20.

The follower 22 has a side formed with an elongated guide channel 223 to allow sliding movement of the pull handle 24. The lower end of the follower 22 has an inside formed with a mounting space 220 connected to the guide channel 223 and the locking grooves 213 of the guide track 21 to receive the locking member 26, the torsion spring 25 and the restoring spring 27. The mounting space 220 of the follower 22 has a first side formed with a fixing hole 221 and a second side formed with a screw hole 222. The upper end of the follower 22 has a side formed with at least one screw bore 224.

The locking member 26 is disposed at an inclined state in the follower 22 and the guide track 21. The locking member 26 has a mediate portion formed with a pivot hole 261 located between the locking portions 260 of the two opposites ends. The locking member 26 has a face formed with a recessed first ramp 262 located between the pivot hole 261 and the locking portion 260 of one of the two opposites ends.

The lift device further comprises a pivot bolt 30 extending through the fixing hole 221 of the follower 22 and the pivot hole 261 of the locking member 26 and screwed into the screw hole 222 of the follower 22 so that the locking member 26 is pivotally mounted on the pivot bolt 30.

The pull handle 24 has an upper end formed with a protruding post 240. The lower end 241 of the pull handle 24 extends through the guide channel 223 of the follower 22 into the mounting space 220 of the follower 22 and has a bottom formed with a second ramp 242 that is movable to press the first ramp 262 of the locking member 26 by an elastic force of the restoring spring 27 so as to pivot the locking member 26 toward the guide track 21.

The inner pipe 23 has an inside formed with a conduit 230 mounted on the upper end of the follower 22 and connected to the guide channel 223 of the follower 22 to allow sliding movement of the pull handle 24. The upper end of the inner pipe 23 has a top provided with a fixing board 33 for mounting an armrest support (not shown). The upper end of the inner pipe 23 has a side formed with a sliding slot 231 connected to the conduit 230 to allow sliding movement of the control knob 28. The lower end of the inner pipe 23 has a surface formed with at least one through hole 232, and the lift device further comprises at least one fixing screw 32 extending through the through hole 232 of the inner pipe 23 and screwed into the screw bore 224 of the follower 22 to secure the follower 22 to the inner pipe 23.

The control knob 28 is located outside of the inner pipe 23 and protrudes from the outer pipe 20 and the guide track 21. The control knob 28 includes a slide 280 slidably mounted on the inner pipe 23, and a retainer 29 secured on the slide 280 and provided with a sleeve 290 extending through the slide 280 and the sliding slot 231 of the inner pipe 23 and mounted on the post 240 of the pull handle 24 to secure the retainer 29 to the pull handle 24 and to attach the slide 280 onto the inner pipe 23. The sleeve 290 of the retainer 29 of the control knob 28 is movable in the sliding slot 231 of the inner pipe 23.

As shown in FIG. 3, the restoring spring 27 pushes the lower end 241 of the pull handle 24 toward the locking member 26 until the second ramp 242 of the pull handle 24 is movable to press the first ramp 262 of the locking member 26 so as to pivot the locking member 26 toward the guide track 21, so that the locking portion 260 of the locking member 26 is locked in the respective locking groove 213 of the guide track 21 at a normal state to fix the follower 22 in the guide track 21 so as to lock the inner pipe 23 onto the outer pipe 20.

Figure 4:
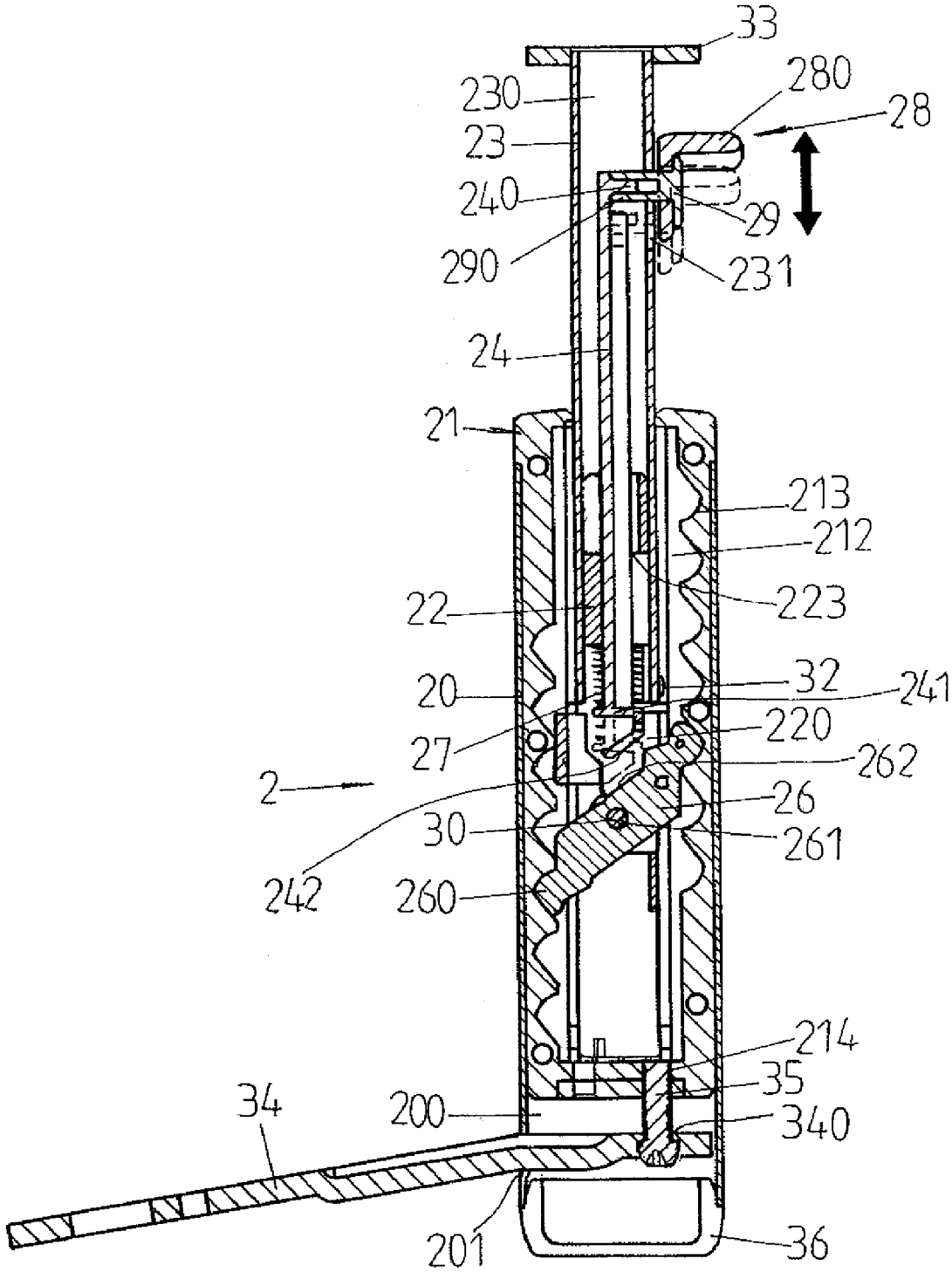
FIG. 4 is a schematic operational view of the lift device as shown in FIG. 3.
Figure 5:
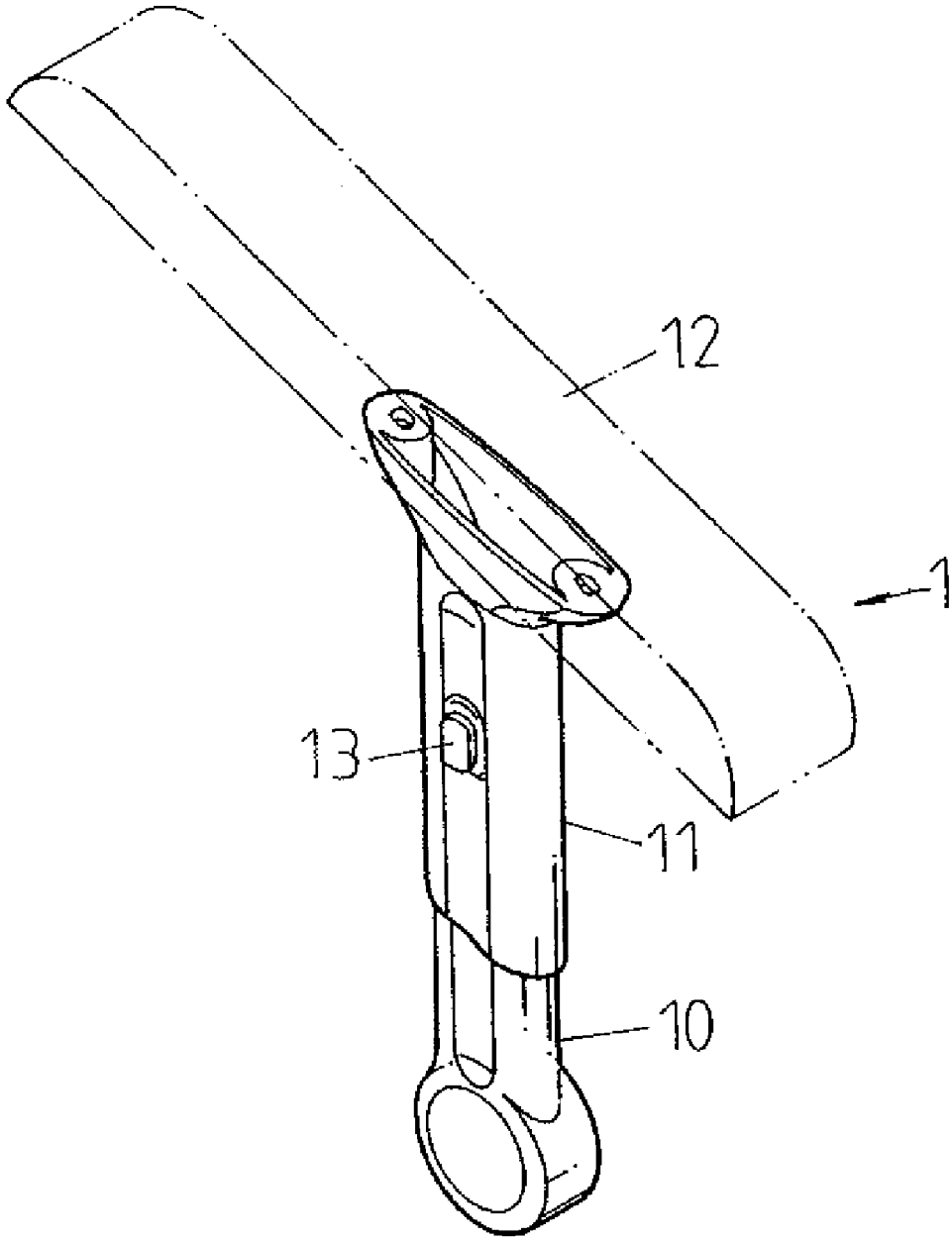
FIG.5 PRIOR ART
FIG. 5 is a perspective view of a conventional lift device for a chair armrest in accordance with the prior art.

In operation, referring to FIGS. 1-4, when the slide 280 of the control knob 28 is pulled to slide upward on the inner pipe 23 and to move from the position as shown in FIG. 3 to the position as shown in FIG. 4, the pull handle 24 is moved upward by the control knob 28, and the lower end 241 of the pull handle 24 is movable to detach from the locking member 26 so as to release the locking member 26, so that the locking member 26 is pushed and pivoted away from the guide track 21 by the restoring force of the torsion spring 25, and the locking portion 260 of the locking member 26 is movable to detach from the respective locking groove 213 of the guide track 21 to unlock the follower 22 from the guide track 21 so as to unlock the inner pipe 23 from the outer pipe 20. Thus, the inner pipe 23 is movable upward and downward relative to the outer pipe 20 to adjust the distance between the inner pipe 23 and the outer pipe 20 so as to adjust the height of the armrest (not shown).

After the force applied on the slide 280 of the control knob 28 disappears, the pull handle 24 is pushed toward the locking member 26 by the restoring force of the restoring spring 27, and the second ramp 242 of the pull handle 24 is movable to press the first ramp 262 of the locking member 26 as shown in FIG. 3 so as to pivot the locking member 26 toward the guide track 21, so that the locking portion 260 of the locking member 26 is locked in another one of the locking grooves 213 of the guide track 21 to fix the follower 22 in the guide track 21 so as to lock the inner pipe 23 onto the outer pipe 20 again.

Accordingly, the guide track 21, the follower 22 and the inner pipe 23 are encompassed by the outer pipe 20 so that the manufacturer only needs to spray paint on the outer pipe 20 without having to spray paint on the guide track 21, the follower 22 and the inner pipe 23, thereby saving the working time and decreasing the costs of fabrication. In addition, the inner pipe 23 is movable in the outer pipe 20 so that the inner pipe 23 will not rub or scratch the outer surface of the outer pipe 20 during a long-term utilization, thereby enhancing the aesthetic quality of the outer pipe 20. Further, the inner pipe 23 is locked onto or unlocked from the outer pipe 20 by pulling or releasing the control knob 28, so that the lift device 2 is operated easily and rapidly, thereby facilitating a user operating the lift device 2 to adjust the height of the armrest.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A lift device, comprising:

an outer pipe;

a guide track secured in the outer pipe and having two opposite sides each formed with a plurality of locking grooves;

an inner pipe movably mounted in the guide track;

a follower having an upper end secured to a lower end of the inner pipe to move with the inner pipe;

a locking member pivotally mounted in a lower end of the follower and having two opposites ends each formed with a locking portion protruding from the follower and detachably locked in one of the locking grooves of the guide track to detachably lock the follower and the inner pipe in the guide track;

a pull handle movably mounted in the inner pipe and having a lower end which is movable to press and pivot the locking member toward the guide track so as to lock the locking portion of the locking member in one of the locking grooves of the guide track;

a control knob movably mounted on an upper end of the inner pipe and connected to an upper end of the pull handle to move the pull handle to press or detach from the locking member;

a restoring spring mounted on the pull handle and biased between the follower and the lower end of the pull handle to push the lower end of the pull handle toward the locking member.

2. The lift device in accordance with claim 1, further comprising a torsion spring mounted on the locking member and biased between the follower and the locking member to push and pivot the locking member away from the guide track so as to unlock the locking portion of the locking member from the respective locking groove of the guide track after the lower end of the pull handle is movable to detach from the locking member.

3. The lift device in accordance with claim 1, wherein the outer pipe has an inside formed with a mounting chamber for mounting the guide track.

4. The lift device in accordance with claim 3, wherein the outer pipe has a lower end having a peripheral wall formed with a passage connected to the mounting chamber;

the outer pipe is attached to a fixing plate which has a distal end extending through the passage into the mounting chamber of the outer pipe;

the distal end of the fixing plate is secured to the guide track.

5. The lift device in accordance with claim 4, wherein the distal end of the fixing plate is formed with a through hole;

the guide track has a lower end formed with at least one screw bore;

the lift device further comprises at least one locking screw extending through the through hole of the fixing plate and screwed into the screw bore of the guide track, so that the guide track is fixed on the fixing plate to attach the outer pipe onto the fixing plate.

6. The lift device in accordance with claim 1, further comprising a bottom cap mounted on the lower end of the outer pipe to close the lower end of the outer pipe.

7. The lift device in accordance with claim 2, wherein the follower has a side formed with an elongated guide channel to allow sliding movement of the pull handle.

8. The lift device in accordance with claim 7, wherein the lower end of the follower has an inside formed with a mounting space connected to the guide channel and the locking grooves of the guide track to receive the locking member, the torsion spring and the restoring spring.

9. The lift device in accordance with claim 8, wherein the mounting space of the follower has a first side formed with a fixing hole and a second side formed with a screw hole;

the locking member has a mediate portion formed with a pivot hole located between the locking portions of the two opposites ends;

the lift device further comprises a pivot bolt extending through the fixing hole of the follower and the pivot hole of the locking member and screwed into the screw hole of the follower so that the locking member is pivotally mounted on the pivot bolt.

10. The lift device in accordance with claim 9, wherein the locking member has a face formed with a recessed first ramp located between the pivot hole and the locking portion of one of the two opposites ends;

the lower end of the pull handle has a bottom formed with a second ramp that is movable to press the first ramp of the locking member by an elastic force of the restoring spring so as to pivot the locking member toward the guide track.

11. The lift device in accordance with claim 8, wherein the lower end of the pull handle extends through the guide channel of the follower into the mounting space of the follower.

12. The lift device in accordance with claim 7, wherein the inner pipe has an inside formed with a conduit mounted on the upper end of the follower and connected to the guide channel of the follower to allow sliding movement of the pull handle;

the upper end of the inner pipe has a side formed with a sliding slot connected to the conduit to allow sliding movement of the control knob.

13. The lift device in accordance with claim 1, wherein the upper end of the follower has a side formed with at least one screw bore;

the lower end of the inner pipe has a surface formed with at least one through hole;

the lift device further comprises at least one fixing screw extending through the through hole of the inner pipe and screwed into the screw bore of the follower to secure the follower to the inner pipe.

14. The lift device in accordance with claim 12, wherein the pull handle has an upper end formed with a protruding post;

the control knob includes a slide slidably mounted on the inner pipe, and a retainer secured on the slide and provided with a sleeve extending through the slide and the sliding slot of the inner pipe and mounted on the post of the pull handle to secure the retainer to the pull handle and to attach the slide onto the inner pipe.

15. The lift device in accordance with claim 14, wherein the sleeve of the retainer of the control knob is movable in the sliding slot of the inner pipe.

16. The lift device in accordance with claim 1, wherein the control knob is located outside of the inner pipe and protrudes from the outer pipe and the guide track.

17. The lift device in accordance with claim 1, wherein the guide track has inside formed with a slideway connected to the locking grooves to allow sliding movement of the inner pipe and the follower.

18. The lift device in accordance with claim 1, wherein the locking member is disposed at an inclined state in the follower and the guide track.

* * * * *